US005345296A

United States Patent [19]

Wellings

[11] Patent Number: 5,345,296

[45] Date of Patent: Sep. 6, 1994

[54] METHODS AND DEVICES FOR DISPERSION OF HIGH SOLIDS TONER

[75] Inventor: Anders J. Wellings, Newark, Del.

[73] Assignee: Xerox Corporation, Stamford, Conn.

[21] Appl. No.: 796,989

[22] Filed: Nov. 25, 1991

[51] Int. Cl.[5] ..... G03G 15/10

[52] U.S. Cl. ..... 355/256; 106/32; 355/260; 430/115

[58] Field of Search ..... 355/245, 256, 257; 222/DIG. 1; 106/32, 218, 224–230, 270, 271, 272; 430/112, 113, 115; 118/654, 660, 661

[56] References Cited

U.S. PATENT DOCUMENTS

| | | | |
|---|---|---|---|
| 4,720,731 | 1/1988 | Suzuki et al. | 118/661 X |
| 4,794,066 | 12/1988 | Taggi et al. | 430/137 |
| 4,860,050 | 8/1989 | Kurotori et al. | 355/256 |
| 4,907,028 | 3/1990 | Higashiyama | 355/27 |
| 5,078,504 | 1/1992 | Landa et al. | 366/118 |

*Primary Examiner*—Lincoln Donovan
*Assistant Examiner*—Christopher Horgan
*Attorney, Agent, or Firm*—Oliff & Berridge

[57] ABSTRACT

The present invention relates to methods and devices for creating high shear forces to disperse high solids toner into a working developer solution. The high solids toner have a toner particle concentration of at least 40% by weight of the working developer solution. An image forming device having such dispersion system includes a latent image device for creating a latent image; a developer device for developing the latent image; a transfer device for receiving the developed latent image onto a predetermined image medium; a developer supplying device for recirculation of a working developer solution through the developer device; a replenishing device for supplying concentrated developer solution preferably at a rate equivalent to a consumption rate of the working developer solution in the developer device; and a dispersion device for dispersing the concentrated developer solution from the replenisher device into the working developer solution of the developer supplying device. The dispersion device includes a rotatable member, a mechanism for rotating the rotatable member, and a stationary member for creating a high shear force at a contact area between the rotatable and stationary members, the high shear force dispersing the concentrated developer solution into the developer solution.

41 Claims, 4 Drawing Sheets

METHODS AND DEVICES FOR DISPERSION OF HIGH SOLIDS TONER

BACKGROUND OF THE INVENTION

1. Field of the Invention

The present invention is directed to methods and devices for dispersion of high solids toner, and in particular to methods and devices of this type which are capable of dispersing high solids toner having toner particle concentration of 40% and higher solids by weight into a working developer solution for use in an image forming devices such as an electrostatic copying machines.

2. Discussion of the Related Art

In electrostatic copying machine, a photosensitive drum is in contact with liquid developer comprising a toner carrier liquid with toner particles dispersed therein. The toner particles of the working developer solution are electrostatically attracted to an electrostatic latent image on the drum. In electrostatic copy machines, a working developer solution having 1%–2% solids by weight of toner particles is used to develop the latent image into a visible toner image.

As the latent image is developed into a visible toner image, the amount of toner particles in the working developer solution is depleted. A replenishing system coupled to the developer tank replenishes the depleted toner particles in the working developer solution. A concentrated developer solution having a toner particle concentration of approximately 10% to 20% solids by weight is usually used to replenish the toner particle depleted working developer solution.

However, the toner particles in the developer solution are depleted more rapidly when successively producing many copies or when copying an original with a large solid image area such as color originals which often have inked areas covering over 40% of the original. Since the proportion of toner carrier liquid (80% to 90%) is much larger than that of the toner particles (10% to 20%) in the concentrated developer solution, the total amount of toner carrier liquid in the working developer solution is increased. For example, if 10% toner particle solution (90% Isopar®) is used for replenishment, Isopar® will rapidly build up in the machine. Further, continuous supply of concentrated developer solution to the developer tank can result in an overflow of the toner carrier liquid in the developer tank.

As environmental restrictions to the release of carrier liquid such as Isopar® to the atmosphere increase, it is important to recover and recirculate the carrier liquid in the developer tank. This requirement makes it even more difficult to maintain the proper mixture ratio without overflowing the developer tank. While level sensors can be used to shut off the replenishment to prevent the overflow situation, copiers copying large area color originals, however, quickly achieve the preset level and are forced to shut down.

Another method of replenishing the toner is the batch process, in which a batch of developer solution having 10% toner particle concentration is prepared in two separate chambers. When the concentration of toner particles falls below 2%, the first chamber gradually releases the batch of developer solution into the developer solution until its supply of batch solution is depleted. Thereafter, the second chamber releases the batch of developer solution whenever the concentration of toner particles falls below 2%. While the second chamber is depleting its supply of the batch solution, the first chamber is replenished with another batch of developer solution. When the second chamber depletes its supply, the process used for the first chamber is repeated for the second chamber. The batch process is disadvantageous because: 1) the preparation of the batch of developer solution is time consuming; and 2) the use of two chambers, rather than one chamber, is not cost efficient.

Another solution is to replenish the developer with replenisher liquid developer having toner particle concentration of 17%–55% by weight. In U.S. Pat. No. 4,860,050 to Kurotori et al., a developing replenisher material or a replenisher liquid developer is supplied to a developer tank of a copy machine. The toner particles of the replenisher liquid developer may be fed into a discharge member contained in a separate chamber. Spiral rollers break the toner particles into smaller toner particles. Further, the discharge member immersed in the liquid developer may have a plurality of small outlet ports and a pair of rotatable spiral rollers having a spiral vane or fin around its peripheral surface. The spiral rollers have axes extending longitudinally of the discharge member and pulley ends around which a drive belt is trained. In another embodiment of Kurotori et al., a jet flow from a pipe forces any replenisher liquid developer which is not well dispersed against a mesh body for dispersion into the liquid developer.

In U.S. Pat. No. 4,794,066, Taggi et al. disclose a process for preparing a liquid developer comprising the steps of: (1) mixing intimately a water-wet presscake pigment with at least one water insoluble vehicle; (2) removing all the water; (3) dispersing at an elevated temperature in the vehicle under high shear the pigment dispersion, a thermoplastic resin, and a non-polar liquid, wherein a temperature is being maintained to plasticize and liquify the resin; and (4) cooling the dispersion. A toner concentrate comprising Isopar may pass through a mesh sieve.

Neither of the two U.S. patents discloses methods and devices for adding toner particles and carrier liquid to the developer tank at a rate equivalent to the consumption rate and to prevent the overflow of the carrier liquid in the developer tank. Further, neither of the two U.S. patents discloses methods and devices using high shear forces to disperse high solids toner in a working developer solution.

All references cited in the specification, and their references, are incorporated by reference herein where appropriate for appropriate teachings of additional or alternative details, features, and/or technical background.

SUMMARY OF THE INVENTION

It is an object of the present invention to provide methods and devices to prevent overflow of the toner carrier liquid in the developer tank.

It is another object of the present invention to provide methods and devices for adding toner particles and carrier liquid to the developer tank at a rate equivalent to the consumption rate.

It is another object of the present invention to provide methods and devices to maintain a constant fluid level of the developer solution in the developer tank of a electrostatic copying machine.

It is another object of the present invention to provide methods and devices for supplying concentrated developer solution at a rate equivalent to the consumption rate by the developer of the working developer solution in the developer tank.

It is another object of the present invention to provide methods and devices for dispersion of high solids toner into a working developer solution.

It is another object of the present invention to provide methods and devices using high shear forces to disperse high solids toner in a working developer solution.

It is another object of the present invention to provide simple and low cost methods and devices for dispersing high solids toner.

It is another object of the present invention to provide methods and devices capable of a continuous process versus a batch process which is time and cost inefficient.

It is another object of the present invention to provide methods and devices capable of combining four separate one color dispersing units into a single four color unit.

It is a further object of the present invention to provide methods and devices for overcoming the problems in the prior art.

To achieve the foregoing and other objects and advantages, and to overcome the shortcomings discussed above, an image forming device in accordance with the invention includes: latent image means for creating a latent image; developer means for developing the latent image; transfer means for receiving the developed latent image onto a predetermined image medium; developer supply means for recirculating a working developer solution through the developer means; replenishing means for supplying concentrated developer solution to the developer supply means preferably at a rate equivalent to a consumption rate of the working developer solution by the developer means and the developer supply means; and dispersion means for dispersing the concentrated developer solution from the replenishing means into the working developer solution in the developer supplying means, the dispersion means comprising a rotatable member, means for rotating the rotatable member, and a stationary member for creating a high shear force at a contact area between the rotatable and stationary members, the high shear force dispersing the concentrated developer solution into the developer solution is disclosed.

Furthermore, a device in accordance with the invention for dispersing high solids toner in a developer solution to maintain a constant fluid level of the developer solution in a developer tank of an image forming device comprises: dispensing means for dispensing the high solids toner; and shearing means having a rotatable member, a stationary member adjacent the rotatable member, and means for rotating the rotatable member relative to the stationary member for creating a high shear force at a contact area between the rotatable and stationary members, the high shear force dispersing the high solids toner into the developer solution of the developer tank.

The present invention also provides a device for dispersion of high solids toner into a working developer solution comprising: a shaft; a metal band partially wrapped around the shaft, the shaft and metal band being rotatable relative to each other; and a dispenser for directing the high solids toner into a nip created between the metal band and the shaft so that the high solids toner is sheared into smaller particles to be dispersed into the working developer solution.

Moreover, the present invention provides for a device for dispersion of high solids toner into a working developer solution comprising: a hollow tube having first and second ends; a mesh covering said second end; a first blade located in the hollow tube, the hollow tube and first blade being rotatable relative to each other; and a dispenser for directing the high solids toner into the hollow tube so that the high solids toner is sheared into smaller particles to be dispersed into the working developer solution.

Additionally, a method in accordance with the invention for dispersing high solids toner into a developer solution comprises the steps of: placing the high solids toner in a contact area between a rotatable member and a stationary member; rotating the rotatable member; and shearing the high solids toner into smaller particles at the contact area to be dispersed into the working developer solution.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Figure 1:
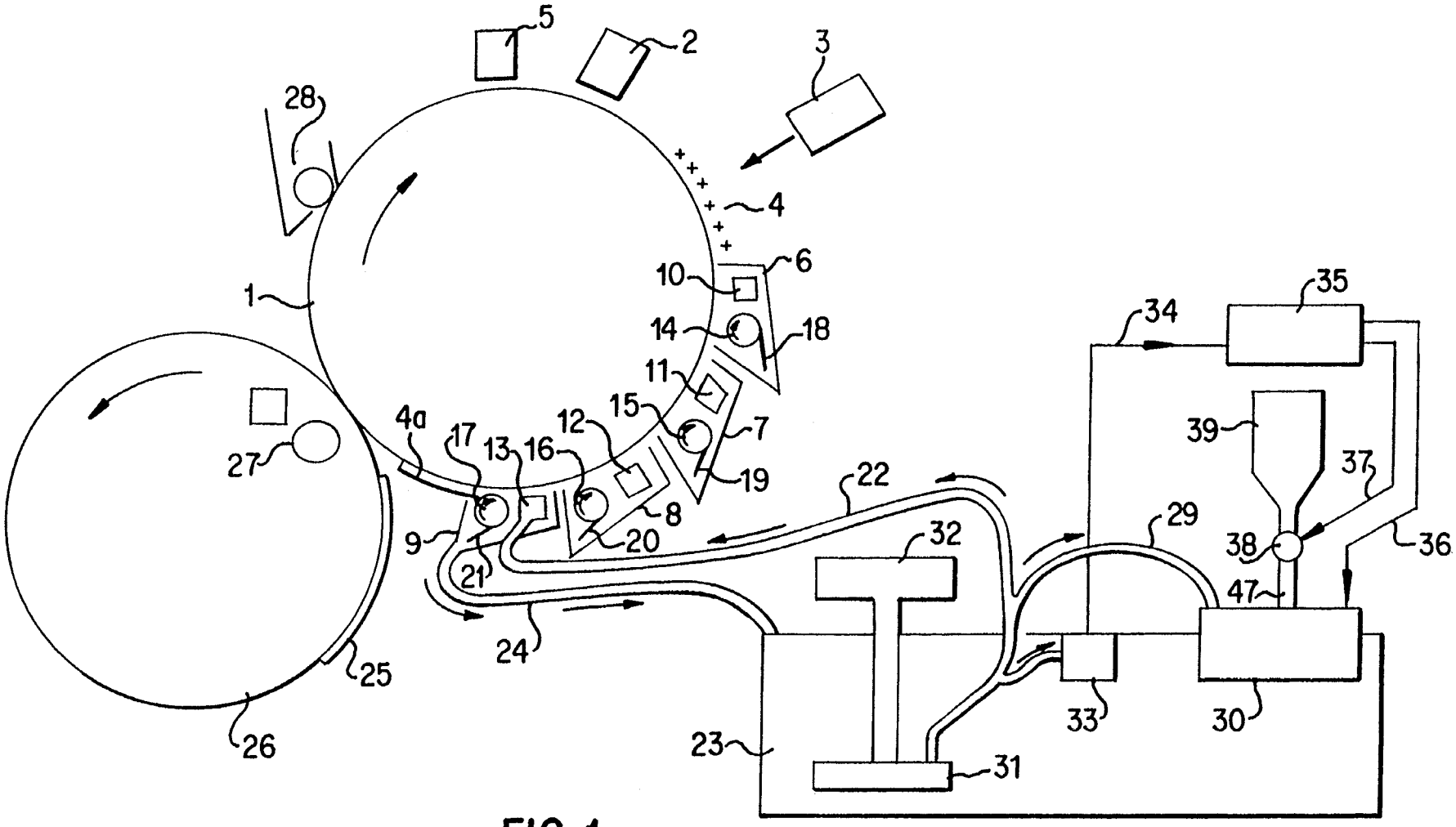
FIG. 1 schematically shows an electrostatic color copying machine using a dispersion system according to the present invention.

FIG. 1 is a schematic drawing of an electrostatic color copying machine. During a copying process, the photosensitive drum I rotates about its own axis in the direction of the arrow by a drive device (not shown). A charge corotron 2 uniformly charges the photosensitive drum 1. A copied image is projected onto the photosensitive drum I through an optical laser system 3 to form an electrostatic latent image 4 on the electrosensitive drum 1.

A plurality of developers 6, 7, 8, 9, develop the electrostatic latent image 4 into a visible toner image 4*a*. In this embodiment, the plurality of developers include a yellow developer 6, magenta developer 7, cyan developer 8, and black developer 9. The developers' color is dependent on the pigment of the toner particles contained in the developer solution. Therefore, the developers' color can be selected dependent upon the color needed to develop the visible toner image 4*a*.

FIG. 1 only shows the black developer tank for simplicity, however, the other developers are connected to developer tanks having similar configuration. Each developer comprises a developer nozzle 10, 11, 12, 13, a developing roller 14, 15, 16, 17, and scrapers 18, 19, 20, 21. A supply line 22 supplies the developer solution to the developer nozzle of the developer. The developing roller which is spaced slightly from the photosensitive drum 1 rotates about its own axis. The developer nozzle and the developing roller develop the electrostatic latent image. The scrapers clean the developing rollers at all times. The developer solution is returned to a developer tank 23 through a return line 24.

The visible toner image 4a is transferred to paper or other suitable medium 25 loaded on the transfer drum 26 at transfer station 27. Thereafter, cleaning station 28 removes any developer solution left on the photosensitive drum 1. Furthermore, any charges remaining on the photosensitive drum 9 are removed by an erase lamp 5.

The working developer solution is recirculated between the black developer tank 23 and the black developer 9 through the supply line 22 and return line 24. Furthermore, recirculation line 29 and dispersion system 30 are used to recirculate the developer solution in the developer tank 23. A pump 31 driven by pump motor 32 recirculates the working developer solution.

The concentration of the toner particles in the working developer solution can vary from 0% (at the initial start up of a new copying machine) to 5%. Usually the concentration of the toner particles in the working developer solution of the present invention is at approximately 2% by weight. A microprocessor 35 responds to a signal from a sensor 33 to detect the concentration of toner particles in the working developer solution (the sensor 33 communicates with supply line 22). When the concentration falls below 2%, the microprocessor 35 sends an output signal 37 to a valve 38. When the valve 38 is opened by the output signal, the replenisher 39 directs high solids toner or concentrated developer solution into the dispersion system 30.

The high solids toner or the concentrated developer solution (herein referred to as high solids toner) comprises toner particles and toner carrier liquid. The toner particles consist typically of a color pigment and a binder resin. The toner carrier liquid can be aliphatic hydrocarbon such as Isopar®. The present invention uses a high solids toner having a toner particles concentration of 10% to 80% and preferably 60%–70%. When the concentration of the toner particles is about 60% to 70% by weight, toner particles and carrier liquid are added to the developer tank at a rate equivalent to the consumption rate. The equilibrium prevents the overflow of carrier liquid in the developer tank.

Such high solids toner is considered to be dry toner and consists of clumps which have an average initial particle size of 1/16 inches. Furthermore, the high solids toner does not readily disperse to its originally manufactured particle size when mixed with the working developer solution. Therefore, a dispersion system is needed for dispersing the high solids toner by reducing its particle size.

Figure 2:
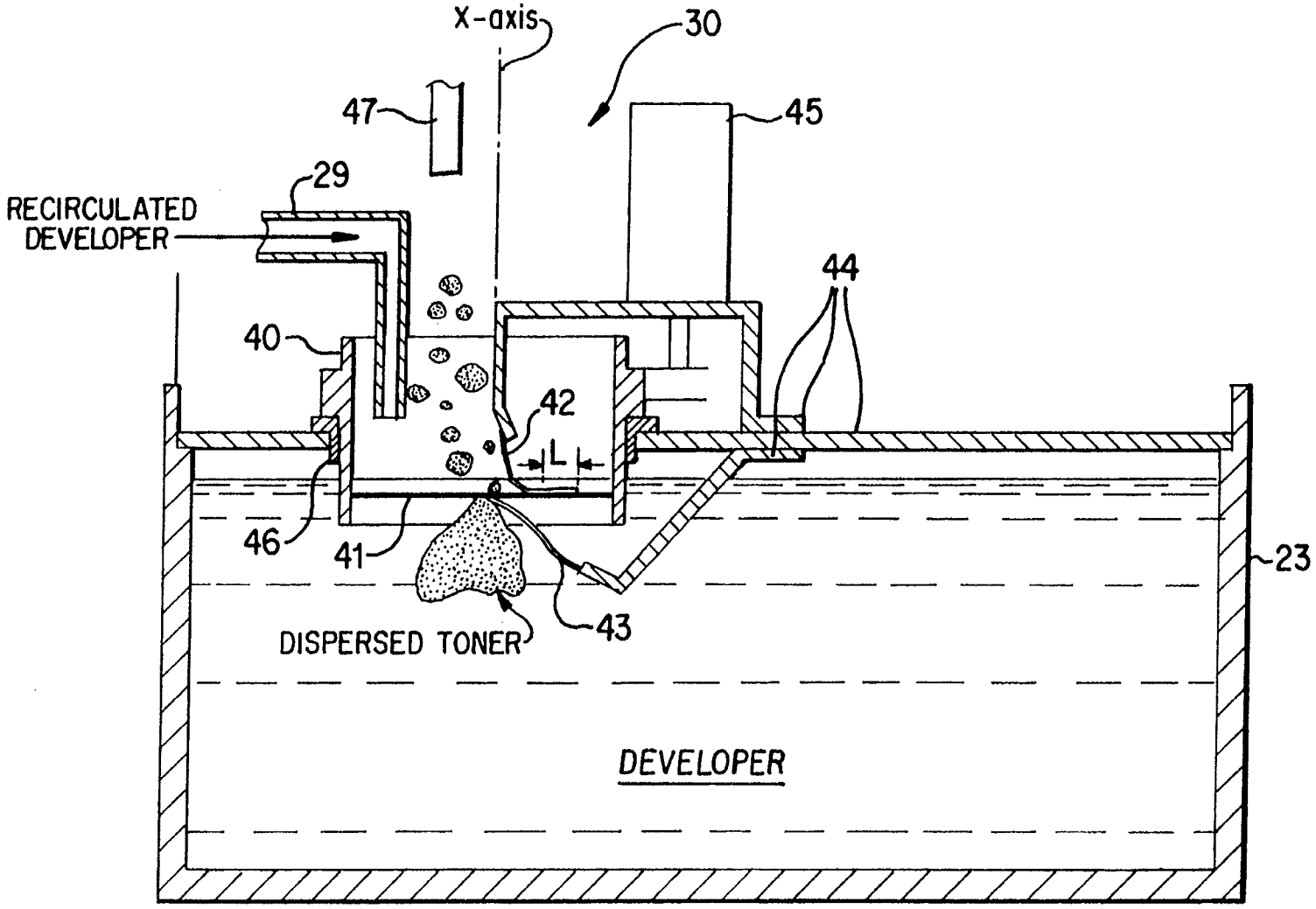
FIG. 2 is an illustration of the first embodiment of the dispersion system in the developer tank of FIG. 1.

FIG. 2 is a sectional view of the first embodiment of the dispersion system, a high shear sieve, in the developer tank. Only the dispersion system is shown in the developer tank for simplicity. The high shear sieve comprises: a rotating sieve made of a hollow tube 40 and a fine wire mesh 41 covering the bottom of the hollow tube; a shearing blade 42; and a scraping blade 43. The sieve is partially submerged into the working developer fluid of the developer tank 23. The fine wire mesh 41 is located slightly below the fluid level of the working developer solution; however, the fine wire mesh can also be located above the fluid level. The sieve is held in the partially submerged position by support bracket system 44. A motor 45 rotates the sieve about the X-axis. A bearing system 46 connected to the support bracket system 44 supports the sieve in the partially submerged position and permits the rotation of the sieve about the X-axis.

Figure 2A:
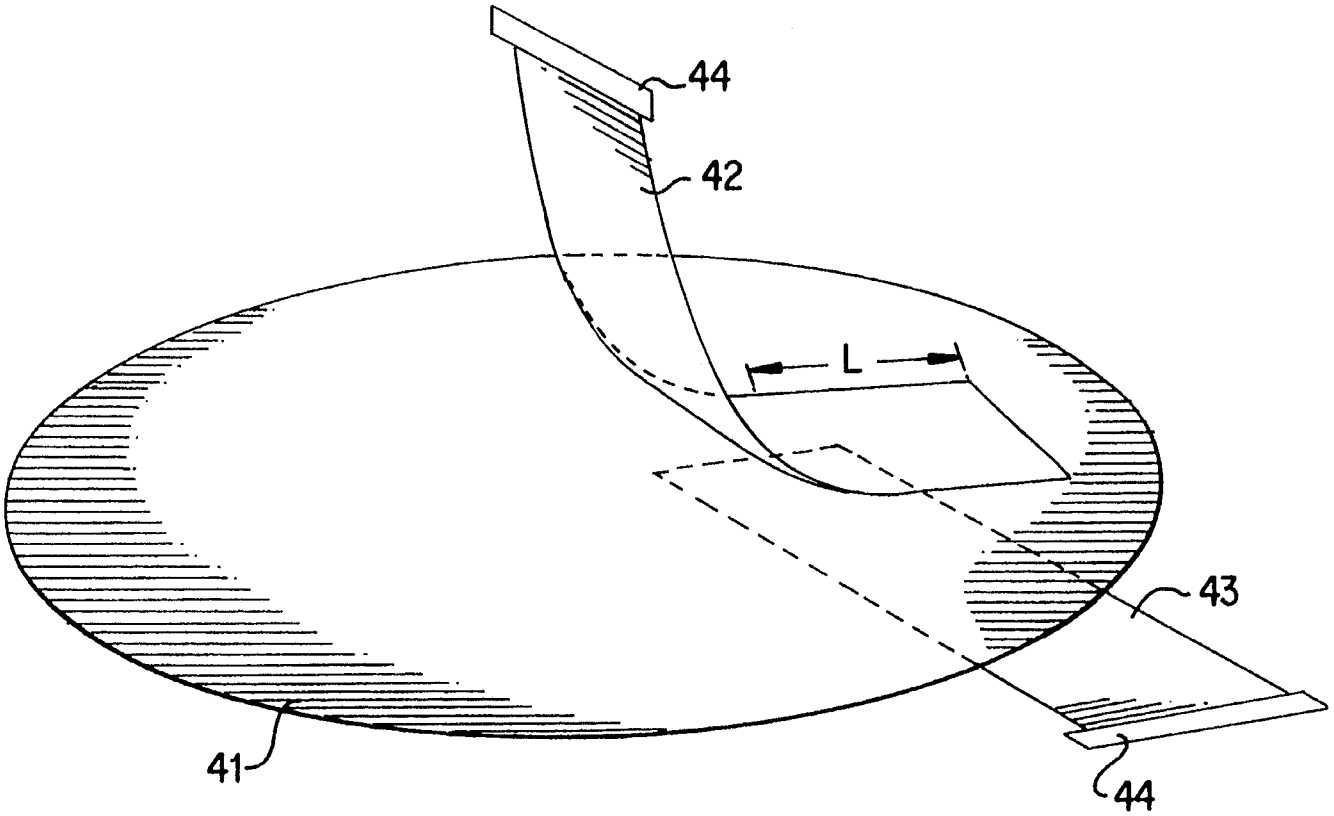
FIG. 2A is an enlargement of the contact area shown in FIG. 2.

As shown in FIG. 2A, the shearing blade 42 is forced to lay partially flat on the top of the mesh screen inside the sieve. The shearing blade and the mesh create a contact area which is used for shearing the high solids toner. The contact length L between the shearing blade 42 and the wire mesh must be ½ inches or greater. A scraping blade 43 located underneath the mesh 41 of the sieve scrapes along the bottom of the screen. Both the shearing blade 42 and the scraping blade 43 are held in the stationary position by the support bracket system 44.

The shearing blade 42 and the scraping blade 43 can be made of spring steel, stainless steel, beryllium copper or any other suitable materials. The present embodiment uses a spring steel having a thickness of 0.010 inches to 0.020 inches, a width of approximately 1 inch, and a straight length of approximately 2 inches. The sieve mesh can be made of stainless steel wire. The openings in the mesh are less than 50 μm to obtain the proper particle size and greater than 10 μm to prevent premature clogging in the mesh.

The microprocessor 35 uses the sensor 33 to detect the concentration of the toner particles in the developer solution. When the concentration of the toner particles becomes less than 2% of the working developer solution, the microprocessor 35 sends an output signal 37 to open the valve 38 and sends a signal 36 to the motor 45 to initiate the rotation of the sieve. The high solids toner contained in the replenisher 39 is sent through the valve and the toner dispenser 47 and is directed onto the top of the fine wire mesh 41 of the sieve.

The high solids toner is mixed with the working developer solution being recirculated through the recirculation line 29 and is dragged for the contact length L between the shearing blade 42 and the fine wire mesh 41. The high solids toner is sheared into smaller particles. This process is repeated until the particles of mainly 1 μm to 2 μm size fall through the fine wire mesh and into the working developer solution. The scraping blade 43 removes any toner particles remaining at the bottom of the fine wire mesh 41 into the working developer solution.

Alternatively, the above embodiment can be readily modified to connect the motor 45 to the blades 42, 43 and to fix the sieve 40, 41 to the support bracket system 44. The process of shearing the high solids toner is the same as the above embodiment of the high shear sieve.

Figure 3:
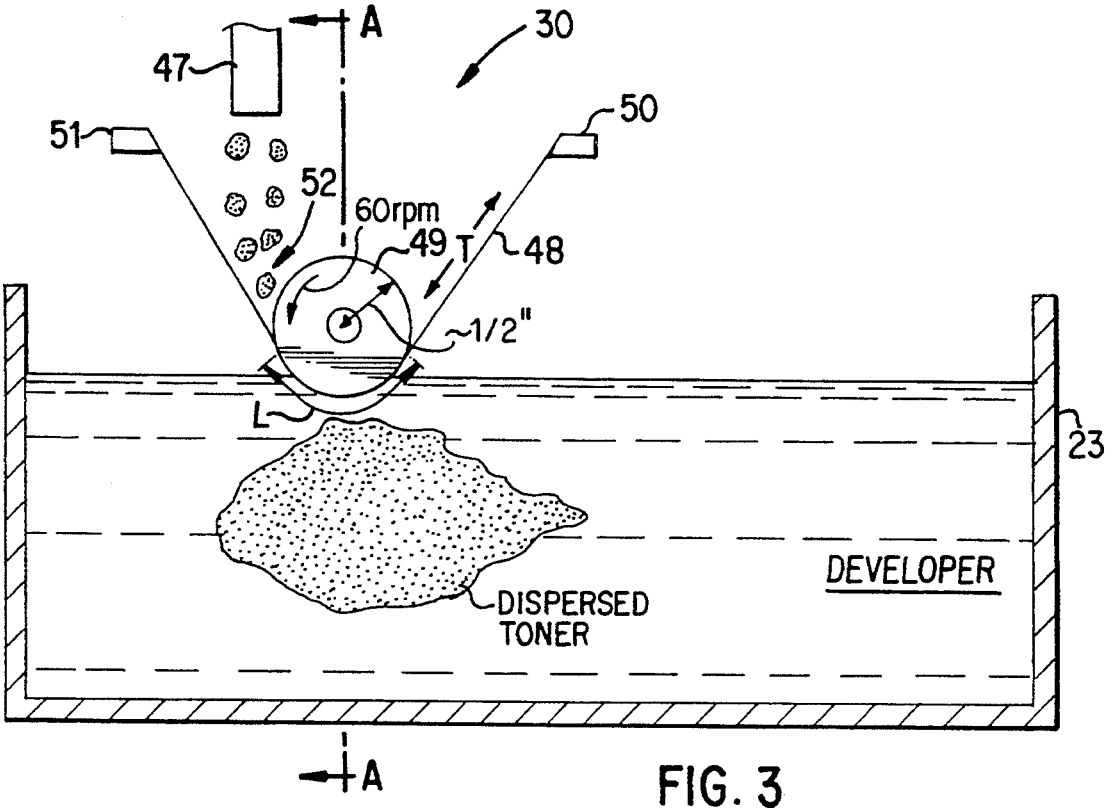
FIG. 3 is an illustration of the second embodiment of the dispersion system in the developer tank of FIG. 1.

FIG. 3 illustrates the second embodiment of the present invention, a high shear friction band. The high shear friction band includes a stationary metal band 48 which is wrapped approximately 180° around a rotating shaft 49. The contact area between the shaft 49 and the friction band 48 creates a contact arc length L which is partially submerged in the working developer solution. The contact arc length L must be one inch or greater. The friction band is held stationary by metal brackets 50 and 51.

The rotating shaft can be made of carbon steel, plated carbon steel, stainless steel, or any other suitable material and has a radius of approximately .5 inches. The friction band can be made of stainless steel with thickness of .003 inches to .015 inches. The present embodiment requires a minimum tension T of approximately 5 pounds to maintain the proper shearing force between the roller and the friction band. The friction band has a width of approximately 3 inches and the toner dispenser 47 is located at the center of the friction band and near the entrance nip 52 created between the stationary friction band 48 and the rotating shaft 49.

Figure 3A:
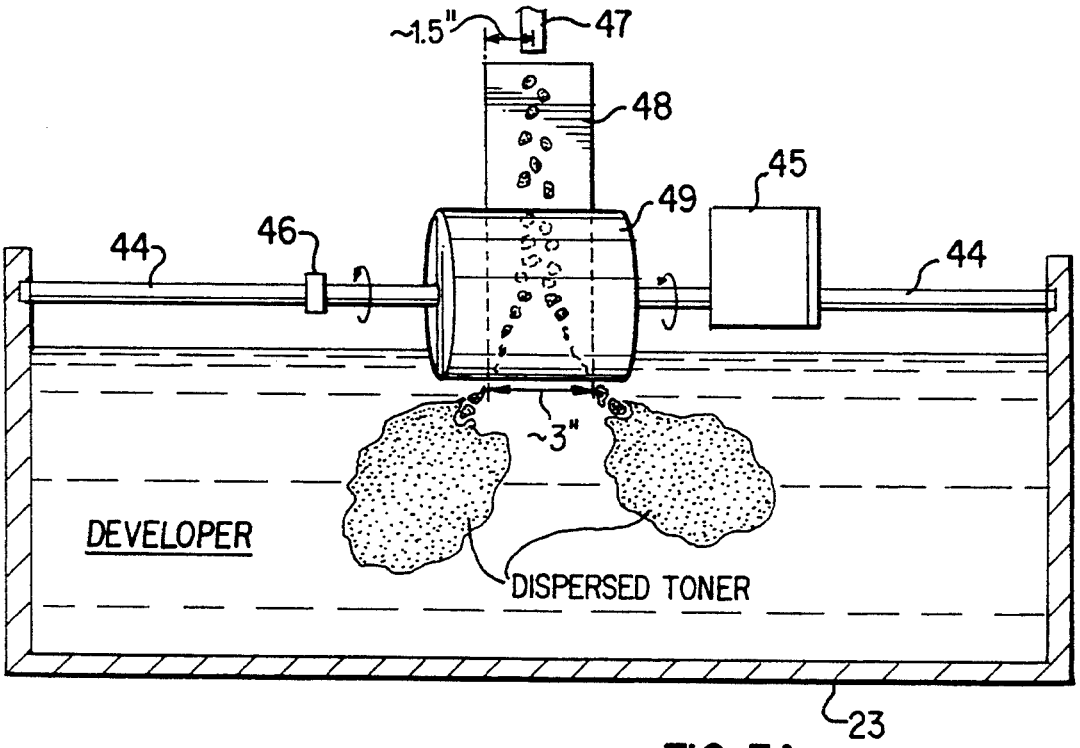
FIG. 3A is a cross-sectional view along A-A of FIG. 3.

When the concentration of toner particles in the working developer solution falls below 2% by weight of the working developer solution, the microprocessor 35 sends signals 36, 37 to initiate the rotation of the shaft by the motor 45 and to open the valve 38. The motor rotates the shaft at approximately 60 revolutions per minute. The high solids toner is dispensed through the toner dispenser 47. The high solids toner is added at the center of the friction band near the entrance nip 52. The toner is then drawn through the friction band and is sheared into smaller particles. This is repeated until the particles drift off the edge of the friction band and into the developer solution as shown in FIG. 3A.

Alternatively, though not shown in the figures, the second embodiment can be easily modified such that the motor 45 initiates the rotation of the metal band 48 and the shaft 49 is held stationary by a support bracket system 44.

With the above methods and devices, high solids toner having 10% to 80% toner particles by weight are dispersed into the working developer solution. Additionally, the present invention can also be used for developer solution having 2%–10% toner particles by weight. Moreover, toner particles of the high solids toner are sheared into particle sizes of 1 to 2 μm. However, the foregoing embodiments are intended to be illustrative and not limiting. Various modifications may be made without departing from the spirit and scope of the invention as defined in the appended claims.

What is claimed is:

1. An image forming device comprising:

a) latent image means for creating a latent image;

b) developer means for developing said latent image;

c) transfer means for transferring said developed latent image onto a predetermined image medium;

d) developer supplying means for recirculating a working developer solution through said developer means;

e) replenishing means for supplying concentrated developed solution to said developer supplying means; and f) dispersion means for dispersing said concentrated developer solution from said replenishing means into said working developer solution of said developer supplying means, said dispersion means comprising a rotatable member, means for rotating said rotatable member, and a stationary member located adjacent to said rotatable member a shear force on said concentrated developer solution to disperse said concentrated developer solution into said developer solution, wherein said shear force reduces a particle size of said concentrated developer solution to about 1–2 μm.

2. The device of claim 1 wherein said concentrated developer solution comprises toner particles and toner carrier liquid, said toner particles being 10%–80% by weight of said concentrated developer solution.

3. The device of claim 1, wherein the replenishing means supplies concentrated developer solution at a rate equivalent to a consumption rate of said working developer solution in said developer means.

4. The device of claim 3 wherein said concentrated developer solution comprises toner particles and tone carrier liquid, said toner particles being 60%–70% by weight of said concentrated developer solution.

5. The device of claim 1 wherein a contact area is defined between the rotatable and stationary members, and the shear force is created in the contact area.

6. A device for dispersion of high solids toner into a working developer solution comprising:

a shaft;

a metal band partially wrapped around said shaft to define a contact area, said shaft and metal band being rotatable relative to each other; and a dispenser for directing said high solids toner into a nip created between said metal band and said shaft so that said high solids toner is sheared in said contact area into smaller particles to be dispersed into said working developer solution.

7. The device of claim 6 wherein said shaft is rotatable and said metal band is fixably mounted, and further comprising:

rotating means for rotating said shaft.

8. The device of claim 6 wherein said high solids toner comprises toner particles and toner carrier liquid, said toner particles being 10%–80% by weight of said high solids toner.

9. The device of claim 6 wherein said high solids toner comprises toner particles and toner carrier liquid, said toner particles being 60%–70% by weight of said high solids toner.

10. The device of claim 6 wherein said contact area has a length of about 1 inch in an axial direction of said shaft.

11. The device of claim 6 wherein said smaller particles have a size of about 1–2 μm.

12. The device of claim 6 wherein said band is wrapped approximately 180° about said shaft.

13. The device of claim 6 wherein the band is maintained with a tension of about five pounds.

14. A device for dispersion of high solids toner into a working developer solution comprising:

a hollow tube having first and second ends;

a mesh covering said second end;

a shearing blade located in said hollow tube, said hollow tube and blade being rotatable relative to each other; and a dispenser for directing said high solids toner into the first end of said hollow tube so that said high solids toner exits said tube at the second end through a contact area between the mesh and the shearing blade, the high solids toner being sheared in the contact area into smaller particles sufficient in size to pass through the mesh and to be dispersed into said working developer solution.

15. The device of claim 14 wherein said hollow tube is rotating and said first blade is fixably mounted, and further comprising:

rotating means for rotating said hollow tube.

16. The device of claim 14 wherein the contact area has a length of about 0.5 inches.

17. The device of claim 14 wherein the mesh has openings of a size between 10–50 μm.

18. The device of claim 14 wherein the smaller particles have a size between 1–2 μm.

19. A The device of claim 14 further comprising a scraper blade located adjacent to said second end on an opposite side of said mesh from said shearing blade, said hollow tube and scraper blade being rotatable relative to each other and said scraper blade removing said smaller particles from said mesh.

20. The device of claim 14 wherein said high solids toner comprises toner particles and toner carrier liquid, said toner particles being 10%–80% by weight of said high solids toner.

21. The device of claim 14 wherein said high solids toner comprises toner particles and toner carrier liquid, said toner particles being 60%–70% by weight of said high solids toner.

22. A device for dispersing high solids toner in a developer solution to maintain a constant fluid level of said developer solution in a developer tank of an image forming device, comprising:

dispensing means for dispensing said high solids toner having an initial particle size; and shearing means having a rotatable member, means for rotating said rotatable member, and a stationary member for creating a shear force at a contact area between said rotatable and stationary members, said shear force dispersing said solids toner into said developer solution of said developer tank, wherein one of said rotatable and stationary members comprises a blade member that contacts the other of said rotatable and stationary members.

23. A device for dispersing high solids toner in a developer solution to maintain a constant fluid level of said developer solution in a developer tank of an image forming device, comprising:

dispensing means for dispensing said high solids toner having an initial particle size; and shearing means having a rotatable member, means for rotating said rotatable member, and a stationary member for creating a shear force at a contact area between said rotatable and stationary member, said shear force dispersing said solids toner into said developer solution of said developer tank, wherein one of said rotatable and stationary member comprises a band member, and the other of said rotatable and stationary members comprises a shaft.

24. The device of claim 22 wherein said rotatable member is a sieve comprising a hollow tube and a mesh covering an end of said hollow tube, and said stationary member is a shearing blade, said shearing blade being located in said hollow tube, and said dispensing means dispenses said high solids toner into said hollow tube so that said high solids toner is sheared into particles having a size smaller than said initial particle size at said contact area between said mesh and said shearing blade.

25. The device of claim 24 wherein said stationary member further comprises a scraping blade located adjacent to said end of said hollow tube on a side of said mesh opposite from said shearing blade, the scraping blade removing said smaller particles from said mesh.

26. The device of claim 22 wherein said high solids toner comprises toner particles and toner carrier liquid, said toner particles being 10%–80% by weight of said high solids toner.

27. The device of claim 22 wherein said high solids toner comprises toner particles and toner carrier liquid, said toner particles being 60%–70% by weight of said high solids toner.

28. A method of dispersing high solids toner having an initial particle size into a developer solution comprising the steps:

placing said high solids toner in a contact area between a rotatable member and a stationary blade member that contacts said rotatable member;

shearing said high solids toner into smaller particles having a size smaller than said initial particle size at said contact area to be dispersed into said working developer solution.

29. The method of claim 28 further comprising the step of:

removing said smaller particles from a side of said rotatable member opposite said stationary member into said working developer solution.

30. The device of claim 5, wherein said contact area has a length between about 0.5–1.0 inches.

31. An image forming device comprising:

a) latent image means for creating a latent image;

b) developer means for developing said latent image;

c) transfer means for receiving said developed latent image onto a predetermined image medium;

d) developer supplying means for recirculating a working developer solution through said developer means;

e) replenishing means for supplying concentrated developer solution to said developer supplying means; and f) dispersion means for dispersing said concentrated developer solution from said replenishing means into said working developer solution of said developer supplying means, said dispersion means comprising a rotatable member, means for rotating said rotatable member, and a stationary member located adjacent to said rotatable member to define a contact area between said rotatable and stationary members, said contact area creating a shear force on said concentrated developer solution to disperse said concentrated developer solution into said developer solution, wherein said contact area has a length between about 0.5–1.0 inches.

32. The device of claim 23 wherein said rotatable member comprises said shaft and said stationary member comprises said band, said band being formed of metal and being fixably mounted and partially wrapped around said shaft, and said dispensing means dispenses said high solids toner into a nip created between said shaft and metal band so that said high solids toner is sheared into particles at said contact area having a size smaller than said initial particle size.

33. A method of dispersing high solids toner having an initial particle size into a developer solution comprising the steps:

placing said high solids toner in a contact area between a rotatable shaft member and a stationary band member;

rotating said rotatable shaft member; and shearing said high solids toner into smaller particles having a size smaller than said initial particle size at said contact area to be dispersed into said working developer solution.

34. The device of claim 22, wherein said contact area has a length between about 0.5–1.0 inches.

35. The device of claim 23, wherein said contact area has a length between about 0.5–1.0 inches.

36. The method of claim 28, wherein said contact area has a length between about 0.5–1.0 inches.

37. The method of claim 33, wherein said contact area has a length between about 0.5–1.0 inches.

38. The device of claim 22, wherein said shear force reduces a particle size of said high solids toner to about 1–2 μm.

39. The device of claim 23, wherein said shear force reduces a particle size of said high solids toner to about 1–2 μm.

40. The method of claim 28, wherein said smaller size is about 1–2 μm.

41. The method of claim 33, wherein said smaller size is about 1–2 μm.

* * * * *